United States Patent [19]

Miles

[11] 4,125,658

[45] Nov. 14, 1978

[54] APPARATUS FOR USE IN DRAWING OR MARKING GRAPHIC CHARACTERS ON A SURFACE

[75] Inventor: John S. Miles, London, England

[73] Assignee: Post Office, London, England

[21] Appl. No.: 702,146

[22] Filed: Jul. 2, 1976

[30] Foreign Application Priority Data

Jul. 3, 1975 [GB] United Kingdom ..... 28042/75

[51] Int. Cl.[2] ..... B41L 13/00; B05C 17/06

[52] U.S. Cl. ..... 428/131; 33/174 B; 35/37; 101/127; 118/301; 428/134; 428/195; 428/914; 40/595

[58] Field of Search ..... 428/914, 131, 134, 135, 428/913, 195, 211; 101/127; 33/174 B; 35/37; 118/301; 156/230, 234, 239, 240; 40/125 R, 2 R, 125 A, 125 E, 135

[56] References Cited

U.S. PATENT DOCUMENTS

| | | | |
|---|---|---|---|
| 152,786 | 7/1874 | Wood | 101/127 |
| 234,492 | 11/1886 | Ream | 101/127 |
| 1,582,809 | 4/1926 | White | 101/127 |
| 2,089,779 | 8/1937 | Adair | 101/127 |
| 2,190,405 | 2/1940 | Humphner | 428/914 |
| 2,970,043 | 11/1961 | Serafin | 33/174 B |
| 3,704,150 | 11/1972 | Barough | 428/131 |
| 3,855,924 | 12/1974 | Morse, Jr. | 101/127 |
| 3,930,092 | 12/1975 | Shapiro | 428/914 |
| 4,015,352 | 4/1977 | Prange | 428/41 |

FOREIGN PATENT DOCUMENTS

| | | | |
|---|---|---|---|
| 1,291,871 | 10/1972 | United Kingdom. | |
| 1,393,795 | 5/1975 | United Kingdom | 428/914 |

*Primary Examiner*—Stanley S. Silverman
*Attorney, Agent, or Firm*—Hall & Houghton

[57] ABSTRACT

Apparatus in the form of a stencil, wet transfer material or dry transfer material is disclosed for marking characters on a surface. A set of character-defining indicia are provided on the stencil or transfer material and symbols having simple geometrical shapes are also provided to enable visually harmonious character spacing to be achieved. Some or all of the indicia have two or more spatially separated symbols so that character spacing can be related to the particular character pair combination being drawn or marked. Simple rules are provided for matching symbols to each other.

10 Claims, 13 Drawing Figures

PATENT FIG. 3A.
PATENT
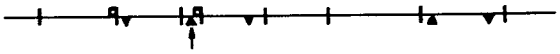
FIG. 3B.
LEAVE FIG. 4A.
LEAVE
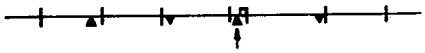
FIG. 4B.
ROYALTY FIG. 5A.
ROYALTY
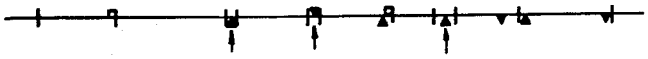
FIG. 5B.
7456 7456
FIG. 6A.
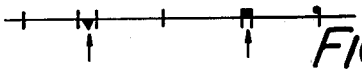
FIG. 6B.

APPARATUS FOR USE IN DRAWING OR MARKING GRAPHIC CHARACTERS ON A SURFACE

This invention relates to apparatus for use in drawing or marking graphic characters on a surface.

Known apparatus for this purpose includes stencils and sheets of pressure-transferable characters. Some such character-transfer sheets include marks to aid the spacing of characters but the spacing achieved does not always produce a visually pleasing appearance unless the user deliberately deviates from the indicated spacing. Good spacing therefore depends on the artistic discretion of the user when these known transfer sheets are used.

It is an object of the invention to provide an apparatus for use in drawing or marking characters on a surface which can provide good spacing of characters without the need for much skill on the part of the user.

According to the invention there is provided apparatus for use in drawing or marking characters on a surface, the apparatus comprising a set of character-defining indicia, there being indicia of a number of different types, each type representing a particular character and associated with each indicium a respective mark having a predetermined location relative to the indicium, wherein the marks comprise symbols of different types, some or all of the indicia having two or more spatially separated symbols of different types such that alignment of matching symbols when drawing or marking two consecutive characters results in a spacing related to the particular character pair combination being drawn or marked.

Said apparatus can take the form of a stencil wherein said indicia and said symbols are formed as perforations in a plate and the characters are drawn through the perforations using a writing implement.

Alternatively said apparatus can take the form of wet or dry transfer materials in which the indicia and symbols are printed on a carrier sheet and can be transferred bodily from the carrier sheet to from characters on a receptor sheet.

The, or one of the, symbols of each and every indicium can be of identical type.

The symbols can be positioned on the left and on the right of their associated indicia for spacing characters across a surface.

Said symbols preferably have the shapes of simple geometrical figures.

Figure 1:
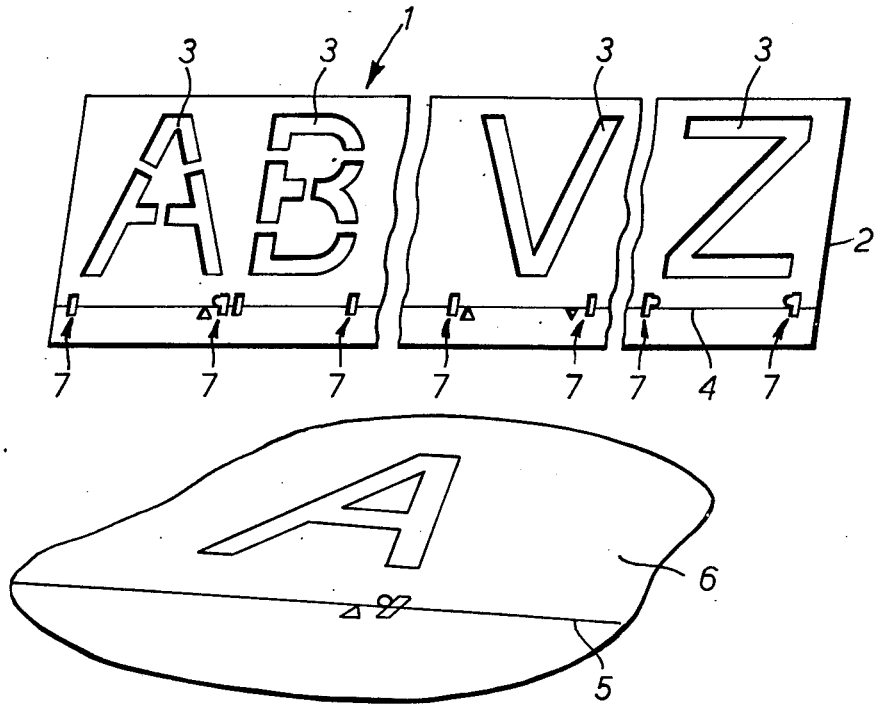
Figure 2A:
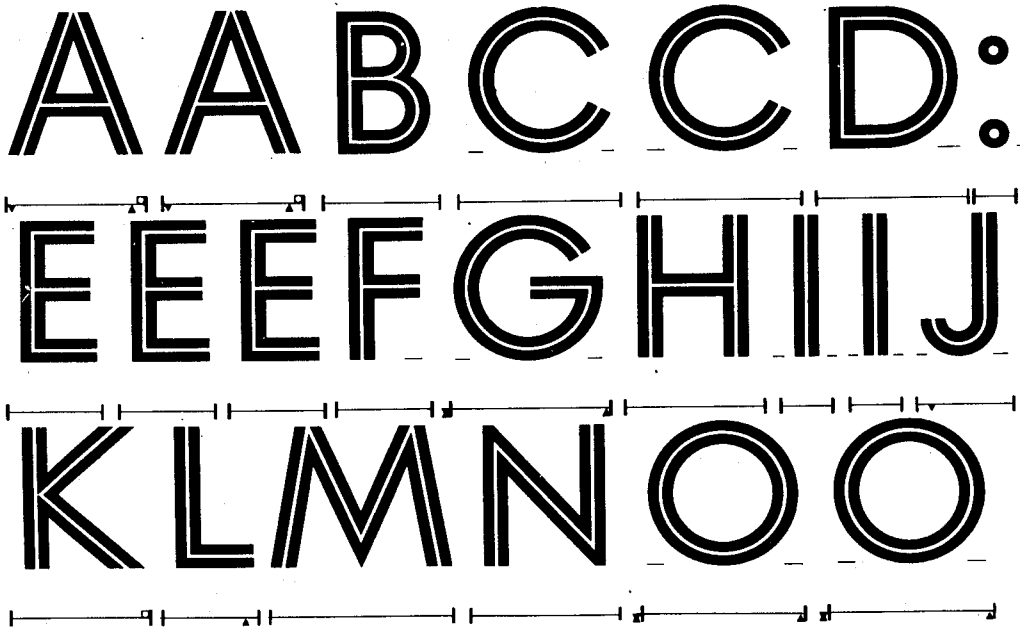
Figure 2B:
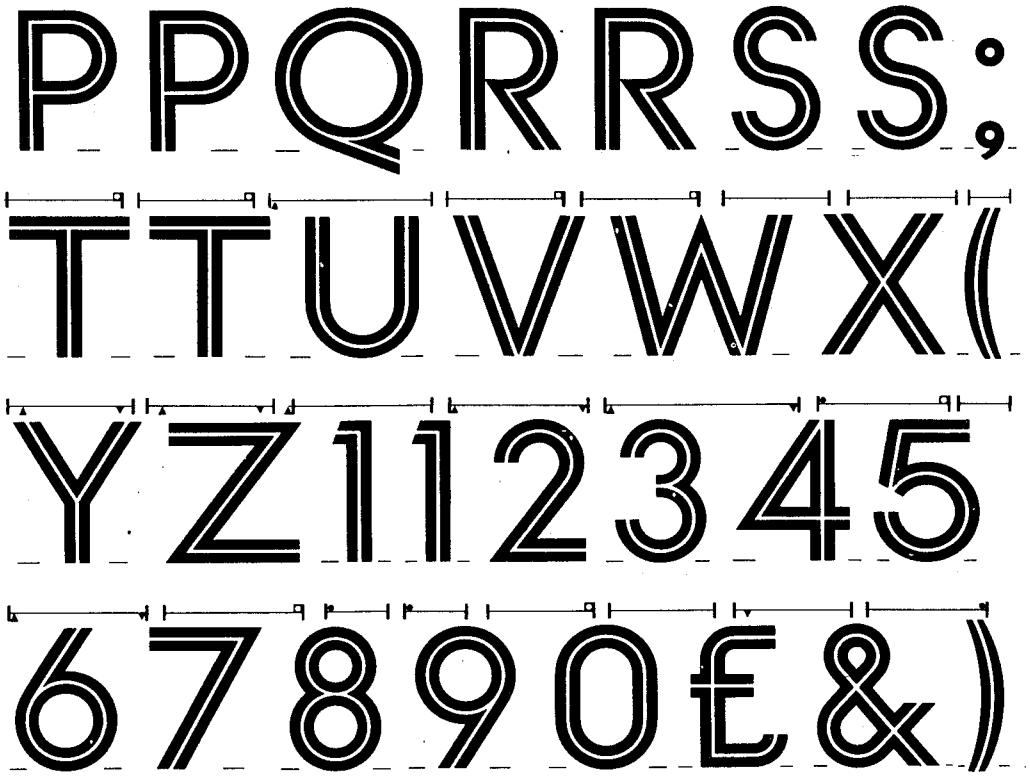
Figure 2C:
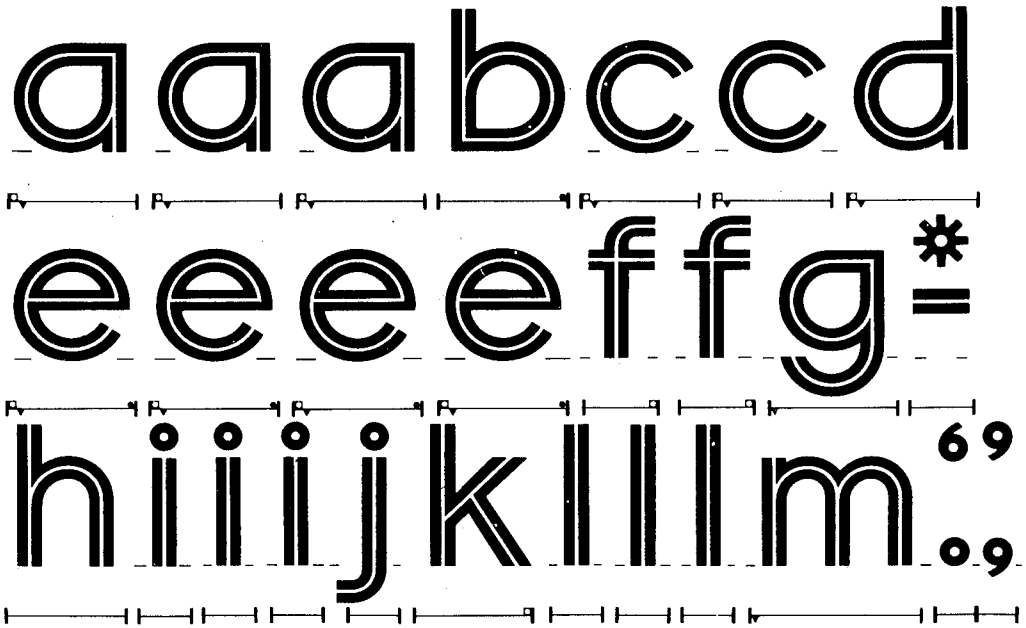
Figure 2D:
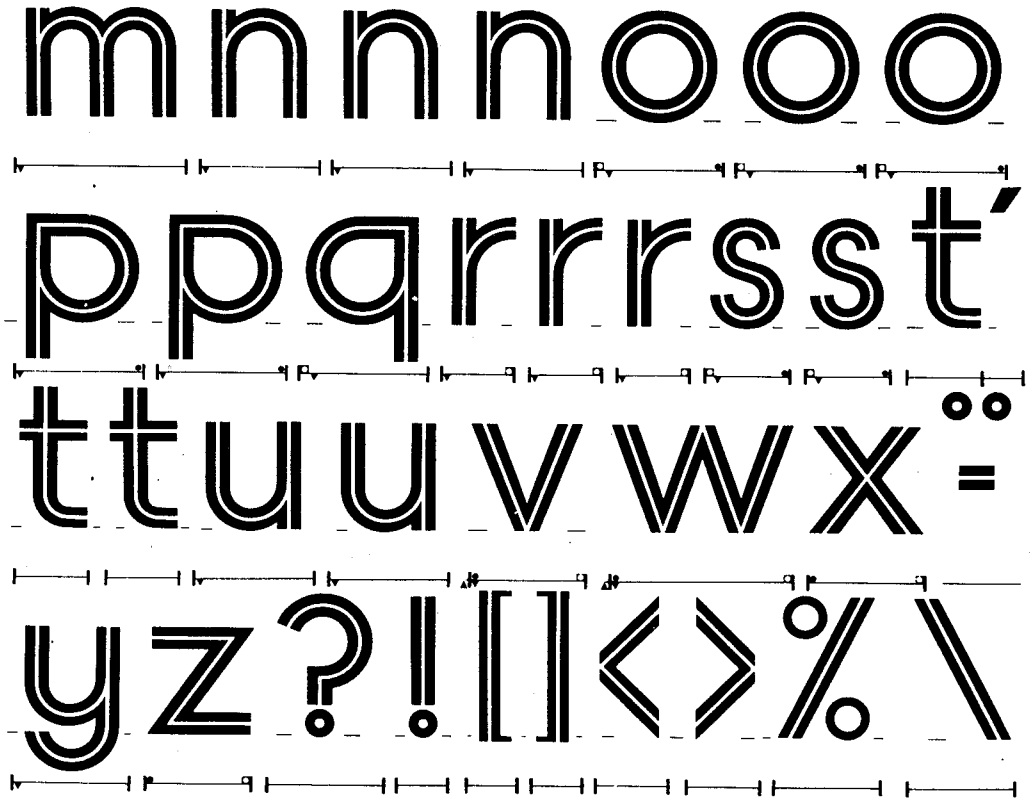

Embodiments of the invention will now be described by way of example with reference to the accompanying diagrammatic drawings in which:

FIG. 1 shows parts of a receptor sheet and a letter stencil embodying the invention;

FIG. 2 portrays part of a character transfer sheet embodying the invention;

FIGS. 3A, 4A, 5A and 6A show the visual effect of the spacing obtained by having the horizontal extremities of characters a roughly standard distance from each other; and FIGS. 3B, 4B, 5B and 6B show corresponding views of the spacing obtained using the apparatus embodying the invention.

Referring to the drawings in detail, FIG. 1 shows part of a letter stencil 1 comprising a transparent plate 2 through which extend perforations 3 shaped to correspond to the outlines of letters of the alphabet. Other perforations can be provided in the stencil 1 corresponding in shape to the outlines of numbers, punctuation marks or specialized characters as is well known in the stencil art.

Below the row of lettering perforations 3 and extending through the plate 2 is an opaque straight-line filament 4 which is parallel to the letters and acts as a reference line for positioning the lettering perforations 3 accurately relative to a corresponding reference line 5 drawn on a receptor sheet 6.

Arranged along the filament 4 and extending through the plate 2 are small distinctly shaped perforations 7. Each of the lettering perforations has an associated array of the perforations 7. Some of the perforations 7 are of rectangular, some of triangular and some of circular shape, and each array is split into 2 subarrays located generally on the respective sides of an associated lettering perforation 3.

The rectangular perforations constitute primary symbols, a primary symbol being located on each side of each lettering perforation 3. The triangular and circular perforations constitute secondary symbols. Some but not all of the lettering perforations have secondary symbols. Some lettering perforations have at least one secondary symbol located on one side only. Other lettering perforations have at least one secondary symbol on each side. The primary perforations are located just outside the horizontal limit of each lettering perforation 3. The secondary symbols are located close to a primary symbol their actual location depending on the identity of the lettering perforation 3.

The primary symbols facilitate spacing of letters on the receptor sheet so that the distance between the horizontal limits of consecutive letters is roughly equal. However for visually harmonious lettering, the eye should see equal areas of background between the stencilled letters, so clearly spacing means which depends only on equal distances between the horizontal limits of letters is insufficient. For example, if the distance between the trailing upright of a letter M and the leading upright of a following letter R is made the same as the distance between the trailing horizontal limit of a letter L and the leading horizontal limit of a following letter T, then the area of background between the letters L and T would be substantially larger than the area between the letters M and R. The secondary symbols facilitate spacing of consecutive letters on the recept sheet so that the areas of background between consecutive letters are visually equal.

When using the stencil 1, a letter, for example the letter A, is drawn through the stencil on to the receptor sheet 6 with the aid of a pencil or like writing implement (not shown), the righthand symbols associated with the letter A, i.e., a circle, an upright triangle and the primary rectangular symbol, being drawn with the stencil in the same position. The stencil 1 is then re-positioned so that the lettering perforation 3 corresponding to the next letter of a word to be stencilled is located to the right of the stencilled letter A. If this following letter is B, which has associated with its lefthand side only a primary rectangular symbol, the primary symbol is placed over the primary symbol below the A and the letter B is stencilled in. Alternatively, if the next letter of the word to be stencilled is a Z which has a circle and a primary rectangular symbol associated with its lefthand side, the lettering perforation Z is placed so that the associated circlue is placed over the circle below the A. Again, if the next letter is a V which has a primary rectangular symbol and an upright triangle associated with its left side, the upright triangle is placed over the upright triangle drawn below the A.

It will be seen that in the event of the array of symbols at the right side of one letter having both a primary symbol and a secondary symbol which matches with symbols of the array at the left of a following letter, then the secondary symbols take matching priority over the primary symbols. Though the embodiments described in this specification are designed so that there can be no plurality of matching secondary symbols between consecutive letters, such a design could be envisaged and in such an event, there could be established a priority system so that one shape of symbol could take precedence over another shape in the same way as the secondary symbols take precedence over primary ones in the present embodiment.

Clearly the designation of symbols to the letters or characters of the stencil depends upon the dimensions of the letters or characters. A typical alphabet together with numbers and punctuation marks, etc., is shown together with the designated symbols in FIG. 2.

FIG. 2 portrays a sheet of transfer materials in which the white background of the drawing is to be viewed as a transparent or translucent carrier sheet from which characters and symbols are bodily detachable for re-application to a receptor sheet (not shown) by a wet or dry transfer process as is well known in the art.

One type of dry transfer material is shown in U.K. patent specification No. 906,934 and comprises a coated carrier sheet upon which are printed letters or other design indicia, the printed indicia being composed of a film-forming ink. The coating of the carrier sheet and the material of the design indicia are such that the design indicia may be transferred bodily to a receptor sheet. The indicia adhere to the receptor sheet by a layer of waxy adhesive either on the surface of the carrier sheet or on the surface of the receptor sheet. Transfer of the indicia is obtained by the application of pressure on the design indicia, the waxy adhesive being made to adhere only by the application of such pressure and provided adhesive forces greater than the forces holding the design indicia to the coating of the carrier.

To manufacture transfer materials embodying the present invention, simultaneously with the design indicia being printed on to the carrier sheet, various symbols are printed to the lower left and to the lower right sides of each indicium, the symbols being accurately located relative to their associated indicium to provide a spacing means as described with reference to FIG. 1. The symbols are themselves bodily transferable to the receptor sheet and may comprise block symbols as shown by the rectangular and triangular symbols associated with many of the indicia shown in FIG. 2. Local matching of symbols is then obtained by overlying a particular symbol with a symbol of identical shape. Alternatively, the symbols may be complementary in shape, i.e., a circular ring at the lower side of one letter and a circular spot at the lower side of a following letter, as would be obtained by the —RX— combination, local matching of the symbols being obtained by locating the spot accurately within the ring.

It can be seen that in using the transfer material to produce a row of characters extending from left to right of a receptor sheet, only the symbols at the lower right side of any indicium need be transferred to the receptor sheet, the symbols to the lower left side acting as a visual positioning aid. Referring to FIGS. 3A, 4A 5A, and 6A, there are shown examples of words and a series of numbers in which the character spacing has been obtained by aligning the marks provided on a prior art transfer sheet. The spacing so obtained consists of a more or less standard spacing between the horizontal extremities of letters. The standard spacing is such as to ensure that in the letter combinations —NT— (FIG. 3A) and —LE— (FIG. 4A) the consecutive letters are spaced adequately apart, but this standard spacing applied to the combination —LT— (FIG. 5A) results in a large area of background between the letter L and the letter T and the resulting layout lacks visual harmony. FIGS. 3B, 4B, 5B and 6B show the same words and number series as are shown in FIGS. 3A, 4A, 5A and 6A. In the former figures however the spacing between consecutive letters and numbers has been determined using the embodiments in the manner described with reference to FIGS. 1 and 2. The primary and secondary symbols associated with the left and righthand sides of each of the letter and number indicia are shown in full, the locally matched secondary symbols of FIGS. 3B to 6B being arrowed.

For the transfer material the following general rules apply and could be printed on the material:

(1) Position left over right; like over like.

(2) Rub down righthand symbols only.

(3) Use primary symbol when no secondary symbols match or appear.

What is claimed is:

1. Apparatus for use in positioning characters on a surface, the apparatus comprising a set of character-defining indicia, there being indicia of a number of different types, each type representing a particular character and associated with each indicium a respective mark on each of two opposite sides of each indicium having a predetermined location relative to the indicium to show how the particular indicium is to be spaced relative to another indicium, said apparatus being improved in that:

(a) it uses a mixture of discrete, visually distinct, symbols consisting of a relatively small group of different symbols, (b) it has said different symbols allocated and positioned to enable two indicia to be spaced by aligning a symbol on one side of the first indicium with a matching symbol on the other side of the second indicium, and (c) it is provided with at least two different symbols on at least one side of at least some of the indicia to enable a user to obtain automatically a spacing between two consecutive characters related to both the particular characters and the particular character pair combination by selecting from said at least two different symbols on said one side a symbol which matches a symbol on the other side of the next letter and by aligning the matching symbols.

2. Apparatus as set forth in claim 1, wherein said apparatus takes the form of a stencil wherein said indicia and said symbols are formed as perforations in a plate and the characters are drawn through the perforations using a writing implement.

3. Apparatus as set forth in claim 1, wherein said apparatus takes the form of a wet transfer material in which the indicia and symbols are printed on a carrier sheet and can be transferred bodily from the carrier sheet to form characters on a receptor sheet.

4. Apparatus as set forth in claim 1, wherein said indicia comprise letters of the alphabet and said symbols are vertically spaced therefrom.

5. Apparatus as set forth in claim 1, wherein said apparatus takes the form of a dry transfer material in which the indicia and symbols are printed on a carrier sheet and can be transferred bodily from the carrier sheet to form characters on a receptor sheet.

6. Apparatus as set forth in claim 5, wherein said symbols have the shapes of simple geometrical figures.

7. Apparatus as set forth in claim 5, wherein a symbol of each and every indicium is of identical type.

8. Apparatus as set forth in claim 7, wherein the symbols are positioned on the left and on the right of their associated indicia for spacing characters across a surface.

9. Apparatus as set forth in claim 1, wherein feature (c) comprises the provision of at least two different symbols on each of said two opposite sides of at least some of the indicia.

10. Apparatus as set forth in claim 9, wherein a selected one of said symbols is provided on each side of each character.

* * * * *